US009598760B2

(12) United States Patent
Shimizu et al.

(10) Patent No.: US 9,598,760 B2
(45) **Date of Patent: *Mar. 21, 2017**

(54) NITRIDED STEEL MEMBER AND MANUFACTURING METHOD THEREOF

(75) Inventors: Yuichiro Shimizu, Tokyo (JP); Atsushi Kobayashi, Saitama (JP); Susumu Maeda, Saitama (JP); Masao Kanayama, Tokyo (JP); Kiyotaka Akimoto, Tokyo (JP)

(73) Assignees: DOWA THERMOTECH CO., LTD., Tokyo (JP); HONDA MOTOR CO., LTD., Tokyo (JP)

( * ) Notice: Subject to any disclaimer, the term of this patent is extended or adjusted under 35 U.S.C. 154(b) by 340 days.

This patent is subject to a terminal disclaimer.

(21) Appl. No.: 14/001,444

(22) PCT Filed: Feb. 22, 2012

(86) PCT No.: PCT/JP2012/054241

§ 371 (c)(1),
(2), (4) Date: Aug. 23, 2013

(87) PCT Pub. No.: WO2012/115135

PCT Pub. Date: Aug. 30, 2012

(65) Prior Publication Data

US 2013/0333808 A1 Dec. 19, 2013

(30) Foreign Application Priority Data

Feb. 23, 2011 (JP) ..... 2011-037032

(51) Int. Cl.
*C23C 8/26* (2006.01)
*C21D 1/06* (2006.01)
(Continued)

(52) U.S. Cl.
CPC ..... *C23C 8/26* (2013.01); *C21D 1/06* (2013.01); *C21D 1/74* (2013.01); *C21D 1/76* (2013.01);
(Continued)

(58) Field of Classification Search
None
See application file for complete search history.

(56) References Cited

U.S. PATENT DOCUMENTS 3,399,085 A 8/1968 Knechtel et al.
2002/0162523 A1* 11/2002 Ishihara ..... C23C 8/26 123/90.27
(Continued)

FOREIGN PATENT DOCUMENTS

CN 101294268 A 10/2008
DE 3706257 C1 4/1988
(Continued)

OTHER PUBLICATIONS

Abraha et al. Vacuum, 83, 2009, 497-500.*
(Continued)

*Primary Examiner* — Vera Katz
(74) *Attorney, Agent, or Firm* — Michael Best & Friedrich LLP

(57) ABSTRACT

The present invention provides a nitrided steel member and manufacturing method thereof. the nitrided steel member including: an iron nitride compound layer formed on a surface of a steel member made of carbon steel for machine structural use or alloy steel for machine structural use, in which with regard to X-ray diffraction peak intensity $IFe_4N$ (111) of the (111) crystal plane of $Fe_4N$ and X-ray diffraction peak intensity $IFe_3N$ (111) of the (111) crystal plane of $Fe_3N$ obtained by measuring a surface of the nitrided steel member by X-ray diffraction, an intensity ratio represented by
(Continued)

$IFe_4N(111)/\{IFe_4N\ (111)+IFe_3N\ (111)\}$ is 0.5 or more, and a thickness of the iron nitride compound layer is 2 to 17 μm.

4 Claims, 3 Drawing Sheets

(51) Int. Cl.

| | |
|---|---|
| ***C21D 1/74*** | (2006.01) |
| ***C21D 1/76*** | (2006.01) |
| ***C21D 9/32*** | (2006.01) |
| ***C22C 38/22*** | (2006.01) |
| ***C22C 38/44*** | (2006.01) |

(52) U.S. Cl.
CPC ..... *C21D 9/32* (2013.01); *C22C 38/22* (2013.01); *C22C 38/44* (2013.01); *C21D 2201/05* (2013.01); *C21D 2221/00* (2013.01)

(56) References Cited

U.S. PATENT DOCUMENTS

| | | | | |
|---|---|---|---|---|
| 2009/0215573 | A1* | 8/2009 | Segawa | B23P 15/14 475/230 |
| 2009/0324825 | A1 | 12/2009 | Everson et al. | |
| 2011/0284133 | A1* | 11/2011 | Sano | C21D 1/06 148/218 |
| 2015/0053311 | A1* | 2/2015 | Shimizu | C21D 1/76 148/230 |

FOREIGN PATENT DOCUMENTS

| | | | |
|---|---|---|---|
| JP | 05-070925 | A | 3/1993 |
| JP | 06-033219 | A | 2/1994 |
| JP | 09-125225 | A | 5/1997 |
| JP | 11-072159 | A | 3/1999 |
| JP | 2006-028588 | A | 2/2006 |

OTHER PUBLICATIONS

International Search Report, mailed Mar. 19, 2012.
Kyuhiko Yamanaka, "*Ion Chikkaho*", First Edition, p. 70, 71, 79 & 141, The Nikkan Kogyo Shinbun, Ltd., Jul. 10, 1976, Japan.
Extended Search Report issued in European Application No. 12750227.6, dated Sep. 28, 2015.
Liedtke et al., "Nitriding and Nitrocarbonizing on Iron Materials," translation into Japanese published by Agne Gijutsu Center, Inc., original published 2010, Japanese translation published Aug. 30, 2011.

* cited by examiner

NITRIDED STEEL MEMBER AND MANUFACTURING METHOD THEREOF

TECHNICAL FIELD

The present invention relates to a nitrided steel member with its surface nitrided by a nitriding treatment and a manufacturing method thereof. Further, the present invention relates to a high strength nitrided steel member to be used for a gear of a vehicle or the like and having improved pitting resistance and bending strength.

BACKGROUND ART

A gear to be used for a transmission for a vehicle, for example, has been required to have high pitting resistance and bending strength, and in order to meet such a requirement, a carburizing treatment has been widely performed until now as a method of strengthening a steel member such as a gear. Further, with the aim of further improving the pitting resistance, there has been proposed an invention related to achievement of high strength by a carbonitriding treatment (Patent Document 1). On the other hand, with regard to a planetary gear, due to its engagement degree being high, an effect of tooth profile accuracy (strain) on gear noise has been large, and particularly, an internal gear has had a problem of being likely to be strained due to being thin and large in diameter. Thus, there has been also proposed an invention related to a gas nitrocarburizing treatment causing less strain of a steel member and also causing small variations in strain (Patent Document 2).

PRIOR ART DOCUMENT

Patent Document

[Patent Document 1] Japanese Laid-open Patent Publication No. 5-70925

[Patent Document 2] Japanese Laid-open Patent Publication No. 11-72159

DISCLOSURE OF THE INVENTION

Problems to be Solved by the Invention

A steel member whose strength has been increased by a gas nitrocarburizing treatment is small in strain amount and strain variations but deteriorates in fatigue strength such as pitting resistance and bending strength as compared to a steel member whose strength has been increased by carburizing or carbonitriding.

Further, a high-strength carbonitrided steel member by carbonitriding described in Patent Document 1 has pitting resistance higher than that of a carburized steel, but has a problem of having low bending strength. Further, it has a problem that a strain amount is increased because a heat treatment is performed in an austenite transformation temperature range of steel. Further, it has a problem that variations in strain are large in a lot and between lots because a quenching process is necessary for carburizing and carbonitriding treatments.

Further, with regard to a nitrided member having had a gas nitrocarburizing treatment performed thereon that is described in Patent Document 2 or the like, by thinning its compound layer, improvement of pitting resistance (a problem of its compound layer on the uppermost surface being peeled off) is achieved, as compared to a compound layer obtained by a conventional gas nitrocarburizing treatment, which is inferior to a carburizing treatment.

An object of the present invention is to provide a high-strength and low-strain nitrided steel member having high pitting resistance and bending strength and further having low strain as compared to carburizing and carbonitriding treatments.

Means for Solving the Problems

As a result of earnest examination for solving the above-described tasks, the prevent inventors found that on a steel member made of carbon steel or alloy steel for machine structural use, a predetermined nitriding treatment is performed to generate an iron nitride compound layer in which its structure (texture) is controlled on the surface of the steel member, and thereby a high-strength and low-strain nitrided steel member having low strain and sufficient pitting resistance and bending strength is obtained, and reached the completion of the present invention.

According to the present invention, there is provided a nitrided steel member including: an iron nitride compound layer formed on a surface of a steel member made of carbon steel for machine structural use or alloy steel for machine structural use, in which with regard to X-ray diffraction peak intensity $IFe_4N$ (111) of the (111) crystal plane of $Fe_4N$ and X-ray diffraction peak intensity $IFe_3N$ (111) of the (111) crystal plane of $Fe_3N$ obtained by measuring a surface of the nitrided steel member by X-ray diffraction, an intensity ratio represented by $IFe_4N$ (111)/{$IFe_4N$ (111)+$IFe_3N$ (111)} is 0.5 or more, and a thickness of the iron nitride compound layer is 2 to 17 μm.

This nitrided steel member desirably includes a nitrogen diffusion layer. The nitrided steel member of the present invention is a gear to be used for a transmission, for example.

Further, according to the present invention, there is provided a manufacturing method of a nitrided steel member including: performing a nitriding treatment on a steel member made of carbon steel or alloy steel for machine structural use in an atmosphere of a nitriding treatment gas in which when the total pressure is set to 1, a partial pressure ratio of $NH_3$ gas is set to 0.08 to 0.34, a partial pressure ratio of $H_2$ gas is set to 0.54 to 0.82, and a partial pressure ratio of $N_2$ gas is set to 0.09 to 0.18, at a flow speed of the nitriding treatment gas set to 1 m/s or more (1 meter per second or more), in a temperature range of 500 to 620° C.; and thereby, forming an iron nitride compound layer having a thickness of 2 to 17 μm on a surface of the steel member.

Incidentally, in the present description, the "iron nitride compound layer" is an iron nitride compound typified by the γ' phase-$Fe_4N$, the ε phase-$Fe_3N$, or the like on the surface of the steel member that is formed by a gas nitriding treatment.

Effect of the Invention

According to the present invention, it is possible to provide a nitrided steel member having sufficient pitting resistance and bending strength and further having low strain as compared to carburizing and carbonitriding treatments.

MODE FOR CARRYING OUT THE INVENTION

Figure 1:
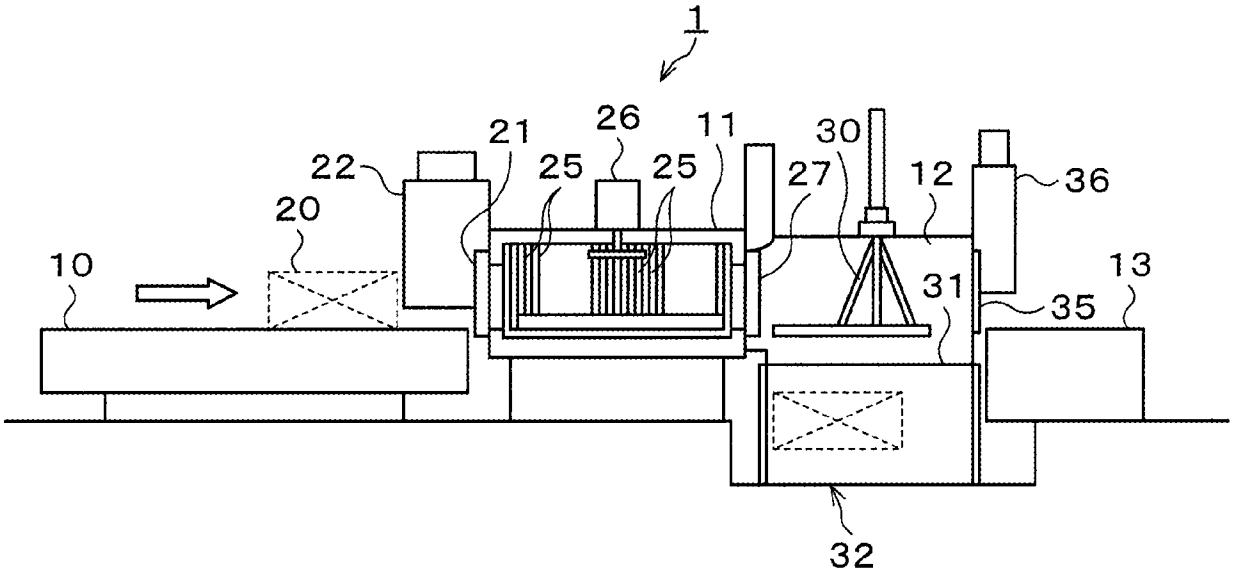
FIG. 1 is an explanatory view of a heat treatment apparatus.

Hereinafter, there will be explained a nitrided steel member of the present invention in detail with reference to the drawings.

The nitrided steel member of the present invention has an iron nitride compound layer having the γ' phase as its main component provided on a surface of a steel member (base metal) made of carbon steel for machine structural use or alloy steel for machine structural use.

The carbon steel for machine structural use of the present invention is indicated by JIS G 4051 ("carbon steels for machine structural use") or the like. As the carbon steel for machine structural use to be used for the nitrided steel member of the present invention, for example, S45C, S35C, and the like are favorable.

Further, the alloy steel for machine structural use of the present invention means a steel product indicated by JIS G 4053 ("alloy steels for machine structural use"), JIS G 4052 ("structure steels with specified hardenability bands (H steel)"), JIS G 4202 ("aluminum chromium molybdenum steels"), or the like, and for example, chromium steel, chromium molybdenum steel, and nickel chromium molybdenum steel are favorable. Further, in terms of symbols of types, SCr420, SCM420, SCr420H, SCM420H, SACM645, SNCM, and the like are particularly favorable as the alloy steel for machine structural use of the present invention.

As for the nitrided steel member of the present invention, the steel member made of the above steel product type is subjected to a gas nitriding treatment, to thereby have the iron nitride compound layer having the γ' phase as its main component formed on the surface thereof. Further, the thickness of the iron nitride compound layer is 2 to 17 μm. When the thickness of the iron nitride compound layer is less than 2 μm, it is too thin and thus it is conceivable that fatigue strength improvement is limited. On the other hand, when the thickness of the iron nitride compound layer exceeds 17 μm, the nitrogen concentration in the γ' phase increases with the increase in the thickness because the nitrogen diffusion speed of the γ' phase is slow, resulting in that the proportion of the ϵ phase increases. As a result, the entire iron nitride compound layer becomes brittle, and thus peeling is likely to occur to make it impossible to expect the fatigue strength improvement. It is further preferred that the thickness of the above-described iron nitride compound layer should be 4 to 16 μm in the case when the above-described reasons and variations in film thickness at the time of mass production are considered.

The reason why pitting resistance and bending strength of the nitrided steel member of the present invention are excellent is conceivable as follows. The γ' phase is an iron nitride compound expressed as $Fe_4N$, has its crystal structure of a FCC (face-centered cubic), and has 12 slip systems, and thus the crystal structure itself is rich in toughness. Further, a fine equiaxed structure is formed, and thus it is conceivable that the fatigue strength improves. Contrary to this, the ϵ phase is an iron nitride compound expressed as $Fe_3N$ and has its crystal structure of a HCP (hexagonal closest packing), and basal sliding is preferential, and thus it is conceivable that the crystal structure itself has a property that "is not easily deformed and is brittle." Further, the ϵ phase forms coarse columnar crystals and has a structure form disadvantageous for the fatigue strength.

With regard to, of the iron nitride compound layer formed on the surface of the nitrided steel member of the present invention, X-ray diffraction peak intensity $IFe_4N$ (111) of the (111) crystal plane of the γ' phase-$Fe_4N$ to appear in the vicinity of 2θ: 41.2 degrees and X-ray diffraction peak intensity $IFe_3N$ (111) of the (111) crystal plane of the ϵ phase-$Fe_3N$ to appear in the vicinity of 2θ: 43.7 degrees by an X-ray diffraction (XRD) profile obtained by using a cupper tube as an X-ray tube, an intensity ratio represented by $IFe_4N(111)/\{IFe_4N\ (111)+IFe_3N\ (111)\}$ becomes 0.5 or more. As described above, the "iron nitride compound layer" is a layer made of the ϵ phase-$Fe_3N$ and/or the γ' phase-$Fe_4N$, and/or the like, and when an X-ray diffraction analysis of the surface of the steel member is performed, the ratio of the above-described X-ray peak intensities is measured, to thereby determine whether or not the γ' phase is the main component. In the present invention, as long as the above-described intensity ratio is 0.5 or more, the iron nitride compound layer formed on the surface of the nitrided steel member can be determined that the γ' phase is the main component, and the pitting resistance and the bending strength of the nitrided steel member become excellent. The above-described intensity ratio is preferably 0.8 or more, and is more preferably 0.9 or more.

Further, it is characterized in that the nitrided steel member of the present invention has a nitrogen diffusion layer. The nitrogen diffusion layer is formed under the above-described iron nitride compound layer in a nitriding treatment process, improves the mechanical strength of the base metal, and also contributes to the improvement of the fatigue strength. The thickness thereof (depth from the surface of the base metal) is not defined in particular because it changes depending on the use of the nitrided steel member, but it is preferably 0.1 to 1.0 mm or so.

Here, the gas nitriding treatment to be performed on the steel member is performed by using a heat treatment apparatus 1 shown in FIG. 1, for example. As shown in FIG. 1, the heat treatment apparatus 1 has a carry-in part 10, a heating chamber 11, a cooling chamber 12, and a carry-out conveyer 13. In a case 20 placed on the carry-in part 10, the steel member made of the carbon steel for machine structural use or alloy steel for machine structural use, such as a gear to be used for an automatic transmission, for example, is housed. On the entrance side of the heating chamber 11 (the left side in FIG. 1), an entrance hood 22 provided with an openable/closable door 21 is attached.

In the heating chamber 11, a heater 25 is provided. Into the heating chamber 11, a treatment gas made of $N_2$ gas, $NH_3$ gas, and $H_2$ gas is introduced, the treatment gas introduced into the heating chamber 11 is heated to a predetermined temperature by the heater 25, and the nitriding treatment of the steel member carried into the heating chamber 11 is performed. On a ceiling of the heating chamber 11, a fan 26 that stirs the treatment gas in the heating chamber 11, uniformizes a heating temperature of the steel member, and controls a wind speed of the treatment gas coming to the steel member is mounted. On the exist side of the heating chamber 11 (the right side in FIG. 1), a middle door 27 that is openable/closable is attached.

In the cooling chamber 12, an elevator 30 lifting and lowering the case 20 having the steel member housed therein is provided. At a lower portion of the cooling chamber 12, an oil tank 32 in which an oil 31 for cooling is stored is provided. On the exist side of the cooling chamber 12 the right side in FIG. 1), an exit hood 36 provided with an openable/closable door 35 is attached.

In the above heat treatment apparatus 1, the case 20 having the steel member housed therein is carried into the heating chamber 11 from the carry-in part 10 by pusher or the like. Then, the treatment gas is introduced into the heating chamber 11, the treatment gas introduced into the heating chamber 11 is heated to a predetermined high temperature by the heater 25, and while the fan 26 is stirring the treatment gas, the nitriding treatment of the steel member carried into the heating chamber 11 is performed.

(Temperature Increasing Process)

Figure 2:
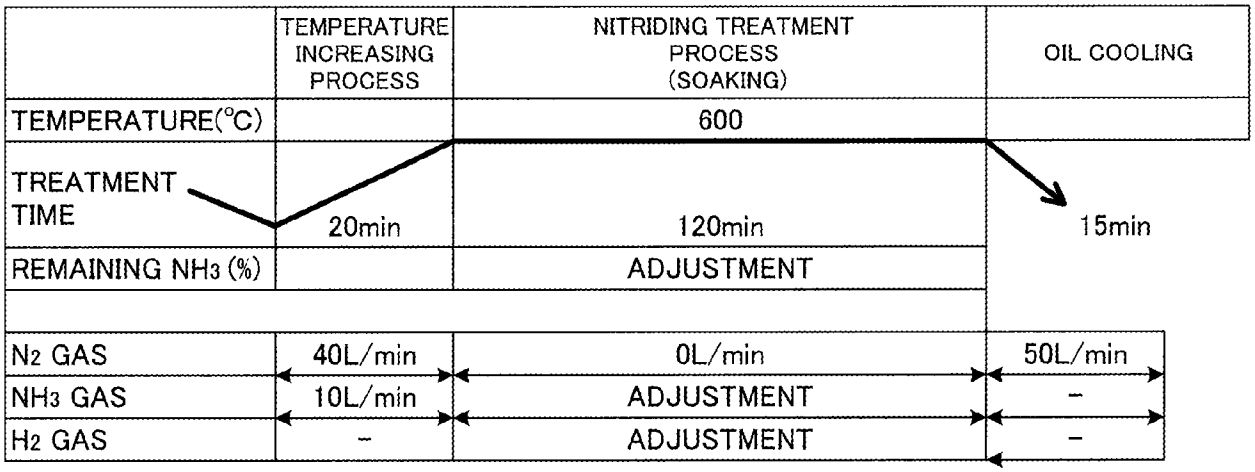
FIG. 2 is a process explanatory diagram of a gas nitriding treatment.

Here, into the heating chamber 11, as shown in FIG. 2, for example, for 20 minutes, the $N_2$ gas of 40 L/min and the $NH_3$ gas of 10 L/min are first introduced to be heated by the heater 25, and a process of increasing the temperature to a nitriding treatment temperature of 600° C. is performed. In the temperature increasing process, precise atmosphere control is not necessary as long as oxidation of the steel member can be prevented during the heating, and in an atmosphere of $N_2$ and Ar being an inert gas, for example, the heating may also be performed. Further, as described above, appropriate amounts of the $NH_3$ gas and the like may also be mixed to make a reducing atmosphere.

(Nitriding Treatment Process)

Thereafter, the $NH_3$ gas and the $H_2$ gas are introduced into the heating chamber 11 in such a manner to control their flow amounts to be a predetermined nitriding treatment gas composition, and are heated by the heater 25 to be soaked at 600° C. for 120 minutes, for example, and a process of performing the nitriding treatment of the steel member is performed. In the process of performing the nitriding treatment of the steel member, a partial pressure ratio of the $NH_3$ gas, a partial pressure ratio of the $H_2$ gas, and a partial pressure ratio of the $N_2$ gas in the heating chamber 11 are each controlled to fall with in a predetermined range. The partial pressure ratios of these gases can be adjusted by the flow amount of the $NH_3$ gas and the flow amount of the $H_2$ gas to be supplied to the heating chamber 11. Incidentally, the $N_2$ gas can be obtained in a manner that the $NH_3$ gas is decomposed at the nitriding treatment temperature. Further, the $N_2$ gas may also be added, and may also be controlled to the above-described partial pressure ratio in a manner to adjust its flow amount.

In the process of performing the nitriding treatment of the steel member, it is preferred that the flow amount of the $NH_3$ gas to be introduced into the heating chamber 11 and the flow amount of the $H_2$ gas to be introduced into the heating chamber 11 should be controlled, and further the $N_2$ gas should be introduced according to need, and the heating temperature of the steel member should be maintained at 500 to 620° C. When the nitriding treatment temperature is higher than 620° C., there is a risk that softening of the member and strain are increased, and when it is lower than 500° C., the speed of forming the iron nitride compound layer slows down, which is not favorable in terms of the cost, and further the $\epsilon$ phase is likely to be formed. It is more preferably 550 to 610° C. Further, the nitriding treatment is preferably performed at 560° C. or higher.

The partial pressure ratios of the gases in the nitriding treatment process are controlled so that the $NH_3$ gas may become 0.08 to 0.34, the $H_2$ gas may become 0.54 to 0.82, and the $N_2$ gas may become 0.09 to 0.18 when the total pressure is set to 1. When the partial pressure ratio of the $H_2$ gas is smaller than 0.54, the iron nitride compound layer having the $\epsilon$ phase as its main component is likely to be generated, and when it exceeds 0.82, there is a risk that the speed of generating the iron nitride compound layer slows down extremely, or no iron nitride compound layer is generated. Further, when the partial pressure ratio of the $NH_3$ gas is larger than 0.34, the iron nitride compound layer having the $\epsilon$ phase as its main component is likely to be generated, and when it is smaller than 0.08, there is a risk that the speed of generating the iron nitride compound layer slows down extremely, or no iron nitride compound layer is generated. Incidentally, the total pressure in the nitriding treatment process may be a reduced pressure atmosphere or pressurized atmosphere. However, in consideration of the manufacturing cost and handleability of the heat treatment apparatus, the total pressure is preferably a substantially atmospheric pressure, which is, for example, 0.9 to 1.1 atmospheres. Further, with regard to the above-described partial pressure ratios of the gases, the $NH_3$ gas is more preferably 0.09 to 0.20, the $H_2$ gas is more preferably 0.60 to 0.80, and the $N_2$ gas is more preferably 0.09 to 0.17 when the total pressure is set to 1.

In the nitriding treatment process of the present invention, by the fan or the like in the heating chamber, the gas speed (wind speed) of the nitriding treatment gas coming to an object to be treated, namely the relative speed of the nitriding treatment gas coming into contact with the surface of an object to be treated is preferably controlled to be 1 m/s or more, and is more preferably controlled to be 1.5 m/s or more. When the wind speed is smaller than 1 m/s, unevenness occurs in the formation of the iron nitride compound layer, or there is also a risk that no iron nitride compound layer is formed. Further, when the wind speed is large, it is possible to evenly form the iron nitride compound layer, but takes measure in terms of the apparatus such that the capability of the fan or the like is increased are necessary for increasing the wind speed. When the manufacturing cost, size, and the like of the apparatus are considered, however, the wind speed is preferably not more than 6 m/s or so. Incidentally, in a conventional gas nitrocarburizing treatment, even when the wind speed is 0 m/s, for example, a nitride compound having the $\epsilon$ phase as its main component is formed without problems. Incidentally, the conventional gas flow speed (wind speed) is 0.5 m/s or so even if the gas is stirred by the fan, and the wind speed varies even in a furnace.

(Cooling Process)

Then, when the process of performing the nitriding treatment of the steel member is finished, the case 20 having the steel member housed therein is next carried into the cooling chamber 12. Then, in the cooling chamber 12, the case 20 having the steel member housed therein is immersed in the oil tank 32 by the elevator 30 and cooling of the steel member is performed for 15 minutes, for example. Then, when the cooling is finished, the case 20 having the steel member housed therein is carried out onto the carry-out conveyer 13. In this manner, the nitriding treatment is finished. Incidentally, the cooling in the cooling process does not have to be the above-described oil cooling, and thus may also be performed by a method of air cooling, gas cooling, water cooling, or the like.

The nitriding treatment is performed under the above condition, to thereby make it possible to obtain the nitrided steel member having, on the surface, the iron nitride compound layer having the $\gamma'$ phase as its main component. The steel member obtained in this manner has the nitrogen diffusion layer and the nitride formed in the inside thereof, to thereby be strengthened, and has the iron nitride compound layer rich in the $\gamma'$ phase formed on the surface thereof, to thereby have the sufficient pitting resistance and bending strength. Besides the above-described analysis by the X-ray diffraction, an EBSP (Electron BackScatter Diffraction Pattern) analysis of the steel member is performed, and thereby it is found that the iron nitride compound layer on the surface is made into a structure rich in the γ' phase (in which the γ' phase is the main component).

Incidentally, the thickness of the iron nitride compound layer can be controlled by the time and the temperature in the atmosphere of the nitriding treatment gas of the present invention. That is, when the time is prolonged, the iron nitride compound layer is thickened, and when the temperature is increased, the speed of generating the iron nitride compound layer is increased.

Further, as compared to the carburizing and carbonitriding treatments, the nitriding treatment of the present invention is a treatment at an austenite transformation temperature or lower, and thus a strain amount is small. Further, a quenching process being a necessary process in the carburizing or carbonitriding treatments can be omitted, and thus a strain variation amount is also small. As a result, it was possible to obtain the low-strain and high-strength and low-strain nitrided steel member.

Further, it is conceivable that with regard to the fatigue strength, the composition (the γ' phase or ϵ phase) of the iron nitride compound layer formed on the surface of the member is dominant. Hereinafter, examples will be described.

EXAMPLE

Example 1

First, as a sample product, steel members each made of the alloy steel for machine structural use SCM420 were prepared. With regard to the shape of the steel member, a disk-shaped test piece for nitride quality confirmation, roller pitting test pieces, a rotary bending test piece, and gear test pieces for strain amount evaluation were prepared, and a variation in tooth profile and a variation in circularity were evaluated.

Next, as a treatment prior to the nitriding, on each of the test pieces, vacuum cleaning and degreasing and drying were performed.

Next, on each of the steel members, the nitriding treatment was performed. First, in the temperature increasing process, the flow amount of the $NH_3$ gas to be supplied into the furnace (heating chamber) was set to 10 L/min, the flow amount of the $N_2$ gas to be supplied into the furnace (heating chamber) was set to 40 L/min, and the temperature was increased to the nitriding treatment temperature. As the condition of the nitriding treatment performed subsequently, the temperature was set to 600° C., the nitriding time was set to 1.5 h (time), the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.15 (the $NH_3$ gas partial pressure was 15.2 kPa), the partial pressure ratio of the $H_2$ gas was set to 0.72 (the $H_2$ gas partial pressure was 73.0 kPa), and the partial pressure ratio of the $N_2$ gas was set to 0.13 (the $N_2$ gas partial pressure was 13.2 kPa). Incidentally, the total pressure in the furnace at the time of the nitriding treatment was an atmospheric pressure and the nitriding gas was strongly stirred by increasing the number of rotations of the fan, to thereby set the gas flow speed (wind speed) of the in-furnace gas coming into contact with the test piece to 2 to 2.6 mm/s Thereafter, each of the test pieces was immersed in the oil at 130° C. to be subjected to oil cooling, and each of the evaluations was performed.

Incidentally, of the nitriding treatment gas, the analysis of the $NH_3$ partial pressure was performed by a "gas nitrocarburizing furnace $NH_3$ analyzer" (manufactured by HORIBA, form FA-1000), the analysis of the $H_2$ partial pressure was performed by a "continuous gas analyzer" (manufactured by ABB, form AO2000), and the balance was set to the $N_2$ partial pressure. Further, the gas flow speed was previously measured by a "windmill anemometer" (manufactured by testo, form 350M/XL) prior to the nitriding treatment, under the same condition (the nitriding treatment gas composition, the number of rotations of the fan, and so on) as that of the nitriding treatment process except that the temperature is the room temperature.

Example 2

Test pieces were manufactured by the manufacturing method similar to that of Example 1 except that as the condition of the nitriding treatment, the flow amounts of the $NH_3$ gas, the $H_2$ gas, and the $N_2$ gas were adjusted, and when the total pressure in the furnace was set to 1, the partial pressure ratio of the $NH_3$ gas was set to 0.14 (the $NH_3$ gas partial pressure was 14.2 kPa), the partial pressure ratio of the $H_2$ gas was set to 0.77 (the $H_2$ gas partial pressure was 78.0 kPa), and the partial pressure ratio of the $N_2$ gas was set to 0.09 (the $N_2$ gas partial pressure was 9.1 kPa), and the temperature was set to 600° C. and the nitriding time was set to 2 hours.

Example 3

Test pieces were manufactured by the manufacturing method similar to that of Example 1 except that as the condition of the nitriding treatment, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.12 (the $NH_3$ gas partial pressure was 12.2 kPa), the partial pressure ratio of the $H_2$ gas was set to 0.72 (the $H_2$ gas partial pressure was 73.0 kPa), and the partial pressure ratio of the $N_2$ gas was set to 0.16 (the $N_2$ gas partial pressure was 16.2 kPa), and the temperature was set to 600° C. and the nitriding time was set to 2 hours.

Example 4

Test pieces were manufactured by the manufacturing method similar to that of Example 1 except that as the condition of the nitriding treatment, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.1 (the $NH_3$ gas partial pressure was 10.1 kPa), the partial pressure ratio of the $H_2$ gas was set to 0.76 (the $H_2$ gas partial pressure was 77.0 kPa), and the partial pressure ratio of the $N_2$ gas was set to 0.14 (the $N_2$ gas partial pressure was 14.2 kPa), and the temperature was set to 610° C. and the nitriding time was set to 8 hours.

Example 5

As a sample product, steel members each made of SCr420 were prepared, and test pieces were manufactured by the manufacturing method similar to that of Example 1 except that as the condition of the nitriding treatment, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.16 (the $NH_3$ gas partial pressure was 16.2 kPa), the partial pressure ratio of the $H_2$ gas was set to 0.74 (the $H_2$ gas partial pressure was 75.0 kPa), and the partial pressure ratio of the $N_2$ gas was set to 0.1 (the $N_2$ gas partial pressure was 10.1 kPa), and the temperature was set to 600° C. and the nitriding time was set to 2 hours.

Example 6

As a sample product, steel members each made of SACM645 were prepared, and test pieces were manufactured by the manufacturing method similar to that of Example 1 except that as the condition of the nitriding treatment, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.16 (the $NH_3$ gas partial pressure was 16.2 kPa), the partial pressure ratio of the $H_2$ gas was set to 0.74 (the $H_2$ gas partial pressure was 75.0 kPa), and the partial pressure ratio of the $N_2$ gas was set to 0.1 (the $N_2$ gas partial pressure was 10.1 kPa), and the temperature was set to 600° C. and the nitriding time was set to 2 hours.

Example 7

As a sample product, steel members each made of SNCM220 were prepared, and test pieces were manufactured by the manufacturing method similar to that of Example 1 except that as the condition of the nitriding treatment, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.16 (the $NH_3$ gas partial pressure was 16.2 kPa), the partial pressure ratio of the $H_2$ gas was set to 0.74 (the $H_2$ gas partial pressure was 75.0 kPa), and the partial pressure ratio of the $N_2$ gas was set to 0.1 (the $N_2$ gas partial pressure was 10.1 kPa), and the temperature was set to 600° C. and the nitriding time was set to 2 hours.

Example 8

As a sample product, steel members each made of S35C were prepared, and test pieces were manufactured by the manufacturing method similar to that of Example 1 except that as the condition of the nitriding treatment, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.16 (the $NH_3$ gas partial pressure was 16.2 kPa), the partial pressure ratio of the $H_2$ gas was set to 0.74 (the $H_2$ gas partial pressure was 75.0 kPa), and the partial pressure ratio of the $N_2$ gas was set to 0.1 (the $N_2$ gas partial pressure was 10.1 kPa), and the temperature was set to 600° C. and the nitriding time was set to 2 hours.

Comparative Example 1

Test pieces were manufactured by the manufacturing method similar to that of Example 1 except that as the condition of the nitriding treatment, the temperature was set to 570° C., the nitriding time was set to 2 hours, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.4 (the $NH_3$ gas partial pressure was 40.5 kPa), the partial pressure ratio of the $H_2$ gas was set to 0.28 (the $H_2$ gas partial pressure was 28.4 kPa), and the partial pressure ratio of the $N_2$ gas was set to 0.32 (the $N_2$ gas partial pressure was 32.4 kPa), and further the nitriding gas was stirred by reducing the number of rotations of the fan, to thereby set the gas flow speed (wind speed) of the in-furnace gas coming into contact with the test piece to 0 to 0.5 m/s.

Comparative Example 2

Test pieces were manufactured by the manufacturing method similar to that of Example 1 except that as the condition of the nitriding treatment, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.1 (the $NH_3$ gas partial pressure was 10.1 kPa), the partial pressure ratio of the $H_2$ gas was set to 0.85 (the $H_2$ gas partial pressure was 86.1 kPa), and the partial pressure ratio of the $N_2$ gas was set to 0.05 (the $N_2$ gas partial pressure was 5.1 kPa), and the temperature was set to 610° C. and the nitriding time was set to 2 hours.

Comparative Example 3

Test pieces were manufactured by the manufacturing method similar to that of Example 1 except that as the condition of the nitriding treatment, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.1 (the $NH_3$ gas partial pressure was 10.1 kPa), the partial pressure ratio of the $H_2$ gas was set to 0.82 (the $H_2$ gas partial pressure was 83.1 kPa), and the partial pressure ratio of the $N_2$ gas was set to 0.08 (the $N_2$ gas partial pressure was 8.1 kPa), and the temperature was set to 610° C. and the nitriding time was set to 2 hours.

Comparative Example 4

Test pieces were manufactured by the manufacturing method similar to that of Example 1 except that as the condition of the nitriding treatment, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.14 (the $NH_3$ gas partial pressure was 14.2 kPa), the partial pressure ratio of the $H_2$ gas was set to 0.73 (the $H_2$ gas partial pressure was 74.0 kPa), and the partial pressure ratio of the $N_2$ gas was set to 0.13 (the $N_2$ gas partial pressure was 13.2 kPa), and the temperature was set to 610° C. and the nitriding time was set to 7 hours.

Comparative Example 5

Test pieces were each manufactured in a manner that the test piece similar to that of Example 1 was subjected to a carburizing treatment by a conventional gas carburizing method and then was subjected to oil quenching.

Comparative Example 6

Test pieces were manufactured by the method similar to that of Example 1 expect that the nitriding gas was stirred by reducing the number of rotations of the fan, to thereby set the gas flow speed (wind speed) of the in-furnace gas coming into contact with the test piece to 0 to 0.5 m/s. That is, the nitriding treatment was performed under the condition in which the gas flow speed is smaller than that of the nitriding treatment gas of the invention of the present application.

Comparative Example 7

As a sample product, steel members each made of SCr420 were prepared, and test pieces were manufactured by the manufacturing method similar to that of Example 1 except that as the condition of the nitriding treatment, the temperature was set to 600° C., the nitriding time was set to 2 hours, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.4 (the $NH_3$ gas partial pressure was 40.5 kPa), the partial pressure ratio of the $H_2$ gas was set to 0.28 (the $H_2$ gas partial pressure was 28.4 kPa), and the partial pressure ratio of the $N_2$ gas was set to 0.32 (the $N_2$ gas partial pressure was 32.4 kPa), and further the nitriding gas was stirred by reducing the number of rotations of the fan, to thereby set the gas flow speed (wind speed) of the in-furnace gas coming into contact with the test piece to 0 to 0.5 m/s.

Comparative Example 8

As a sample product, steel members each made of SACM645 were prepared, and test pieces were manufactured by the manufacturing method similar to that of Example 1 except that as the condition of the nitriding treatment, the temperature was set to 600° C., the nitriding time was set to 2 hours, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.4 (the $NH_3$ gas partial pressure was 40.5 kPa), the partial pressure ratio of the $H_2$ gas was set to 0.28 (the $H_2$ gas partial pressure was 28.4 kPa), and the partial pressure ratio of the $N_2$ gas was set to 0.32 (the $N_2$ gas partial pressure was 32.4 kPa), and further the nitriding gas was stirred by reducing the number of rotations of the fan, to thereby set the gas flow speed (wind speed) of the in-furnace gas coming into contact with the test piece to 0 to 0.5 m/s.

Comparative Example 9

As a sample product, steel members each made of SNCM220 were prepared, and test pieces were manufactured by the manufacturing method similar to that of Example 1 except that as the condition of the nitriding treatment, the temperature was set to 600° C., the nitriding time was set to 2 hours, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.4 (the $NH_3$ gas partial pressure was 40.5 kPa), the partial pressure ratio of the $H_2$ gas was set to 0.28 (the $H_2$ gas partial pressure was 28.4 kPa), and the partial pressure ratio of the $N_2$ gas was set to 0.32 (the $N_2$ gas partial pressure was 32.4 kPa), and further the nitriding gas was stirred by reducing the number of rotations of the fan, to thereby set the gas flow speed (wind speed) of the in-furnace gas coming into contact with the test piece to 0 to 0.5 m/s.

Comparative Example 10

As a sample product, steel members each made of S35C were prepared, and test pieces were manufactured by the manufacturing method similar to that of Example 1 except that as the condition of the nitriding treatment, the temperature was set to 580° C., the nitriding time was set to 1.5 hours, the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.4 (the $NH_3$ gas partial pressure was 40.5 kPa), the partial pressure ratio of the $H_2$ gas was set to 0.28 (the $H_2$ gas partial pressure was 28.4 kPa), and the partial pressure ratio of the $N_2$ gas was set to 0.32 (the $N_2$ gas partial pressure was 32.4 kPa), and further the nitriding gas was stirred by reducing the number of rotations of the fan, to thereby set the gas flow speed (wind speed) of the in-furnace gas coming into contact with the test piece to 0 to 0.5 m/s.

[Evaluation Method]

1. Measurement of the Thickness of the Iron Nitride Compound Layer

The disk-shaped test piece was cut by a cutting machine, its cross section was polished with an emery paper, and a polished surface was mirror-finished with a buff. The above-described cross section was observed by using a metallurgical (optical) microscope at 400 magnifications to measure the thickness of the iron nitride compound layer.

2. The Depth (Thickness) of the Nitrogen Diffusion Layer (Measurement of Hardness Distribution)

Based on "Vickers hardness test—test method" described in JIS Z2244 (2003), a test force was set to 1.96 N and the hardness was measured at predetermined intervals from the surface of the disk-shaped test piece, and based on "Method of measuring nitrided case depth for iron and steel" in JIS G 0562, the distance from the surface to the point where the hardness is 50 HV higher than that of the base metal was set to the thickness of the diffusion layer.

3. X-Ray Diffraction

A Cu tube was used as an X-ray tube, and at a voltage: 40 kV, a current: 20 mA, a scan angle 2θ: 20 to 80°, and with a scan step 1°/min, the X-ray diffraction of the surface of the disk-shaped test piece was performed.

At that time, with regard to the X-ray diffraction peak intensity $IFe_4N$ (111) of the (111) crystal plane of $Fe_4N$ to appear in the vicinity of 2θ: 41.2 degrees and the X-ray diffraction peak intensity $IFe_3N$ (111) of the (111) crystal plane of $Fe_3N$ to appear in the vicinity of 2θ: 43.7 degrees by the X-ray diffraction profile, the intensity ratio of the peak intensities represented by $IFe_4N(111)/\{IFe_4N\ (111)+IFe_3N\ (111)\}$ (XRD diffraction intensity ratio) was measured. Incidentally, the peak intensity concretely indicates the peak height in the X-ray diffraction profile.

4. Roller Pitting Test

Figure 3:
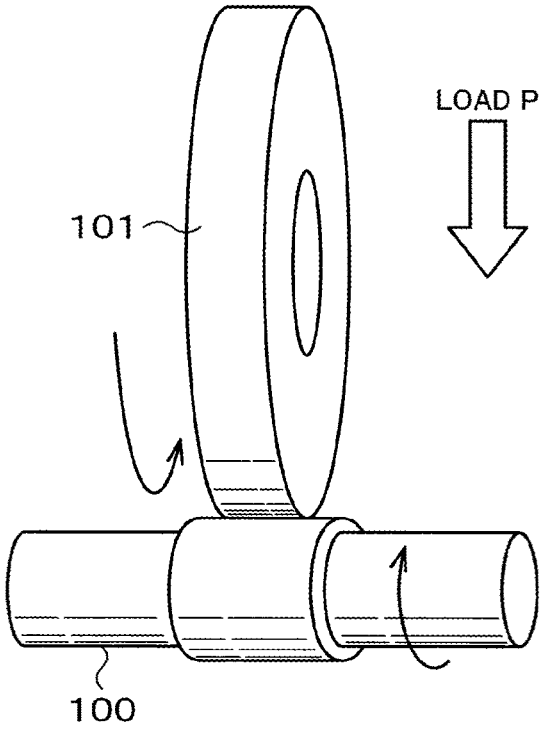
FIG. 3 is an explanatory view of a roller pitting test.

By using an RP201 type fatigue strength testing machine, the test was performed under the condition of a slip ratio: −40%, a lubricant: ATF (lubricant for an automatic transmission), a lubricant temperature: 90° C., an amount of the lubricant: 2.0 L/min, and die roller crowning: R700. As shown in FIG. 3, a small roller 100 was made to rotate while pressing a large roller 101 against the small roller 100 with a load P. The test was performed under the two conditions of the number of rotations of the small roller: 1560 rpm and a contact pressure: 1300 MPa and 1500 MPa. Further, the large and the small roller pitting test pieces were subjected to the same nitriding treatment with the same material.

5. Ono-Type Rotating Bending Fatigue Test

Figure 4:
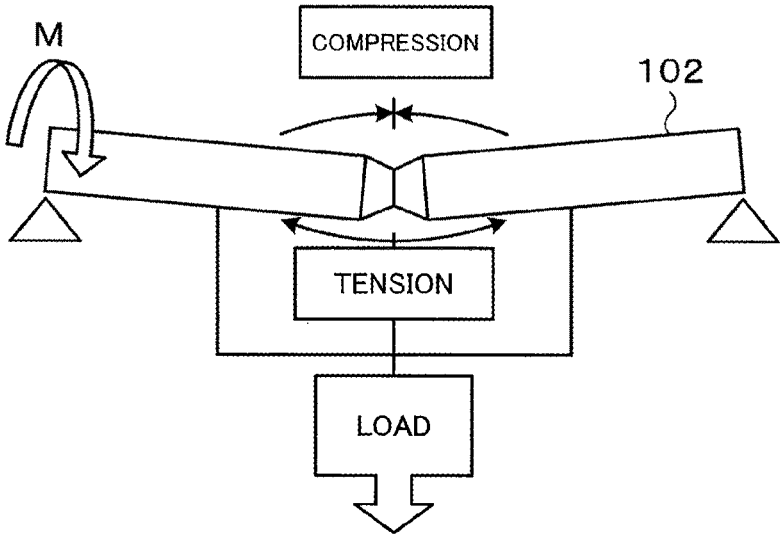
FIG. 4 is an explanatory view of an Ono-type rotating bending fatigue test.

In an Ono-type rotating bending fatigue strength testing machine, the evaluation was performed under the test condition described below. As shown in FIG. 4, a test piece 102 was made to rotate in a state of a bending moment M being applied thereto, and thereby a compressive stress was repeatedly applied to the upper side of the test piece 102 and a tensile stress was repeatedly applied to the lower side of the test piece 102 to perform the fatigue test.

Temperature: the room temperature

Atmosphere: in the atmosphere

The number of rotations: 3500 rpm

6. Gear Strain Amount

For the evaluation, by machining, internal gears each having an outer diameter ϕ of 120 mm, a tip inner diameter ϕ of 106.5 mm, a gear width of 30 mm, a module of 1.3, 78 teeth, and a torsion angle/pressure angle of 20 degrees were manufactured and were subjected to the above-described nitriding treatment or a carburizing treatment, and a variation in tooth profile and a variation in circularity were measured and evaluated. As the evaluation, a tooth trace inclination of the tooth profile was used. The tooth trace inclination was measured every 90 degrees at 4 teeth in the single gear, and the 10 gears were similarly measured and then the maximum width was set to the variations in the tooth trace inclination. Further, as the circularity, a variation in the circularity was evaluated and an average value of the variation in the circularity in the 10 gears was set to the variation in the circularity.

(Evaluation Result)

1. Measurement of the Thickness of the Iron Nitride Compound Layer

The thickness of the iron nitride compound layer in each of Examples was 6 μm (Example 1), 2 μm (Example 2), 9 μm (Example 3), 13 μm (Example 4), 10 μm (Example 5), 3 μm (Example 6), 7 μm (Example 7), and 11 μm (Example 8). Further, the thickness of the iron nitride compound layer in each of Comparative examples was 15 μm (Comparative example 1), about 0 to 0.5 μm and varied (Comparative example 2), 1 μm (Comparative example 3), 18 μm (Comparative example 4), about 0.5 to 1 μm and varied (Comparative example 6), 18 μm (Comparative example 7), 15 μm (Comparative example 8), 17 μm (Comparative example 9), and 16 μm (Comparative example 10).

2. Depth (Thickness) of the Nitrogen Diffusion Layer

The thickness of the nitrogen diffusion layer in each of Examples was 0.22 mm (Example 1), 0.28 mm (Example 2), 0.20 mm (Example 3), 0.52 mm (Example 4), 0.23 mm (Example 5), 0.18 mm (Example 6), 0.20 mm (Example 7), and 0.11 mm (Example 8). Further, the thickness of the nitrogen diffusion layer in each of Comparative examples was 0.22 mm (Comparative example 1), 0.21 mm (Comparative example 2), 0.21 mm (Comparative example 3), 0.47 mm (Comparative example 4), 0.20 mm (Comparative example 6), 0.24 mm (Comparative example 7), 0.19 mm (Comparative example 8), 0.21 mm (Comparative example 9), and 0.10 mm (Comparative example 10).

3. Analysis of the Compound Layer by the X-Ray Diffraction

The intensity ratio by the X-ray diffraction in each of Examples was 0.978 (Example 1), 0.986 (Example 2), 0.981 (Example 3), 0.982 (Example 4), 0.971 (Example 5), 0.979 (Example 6), 0.980 (Example 7), and 0.980 (Example 8), and in each of Examples, the intensity ratio was 0.5 or more, and the iron nitride compound layer was determined that the γ' phase is the main component. Further, also in Examples 5 to 8, the iron nitride compound layer was determined that the γ' phase is the main component.

Further, the intensity ratio by the X-ray diffraction in each of Comparative examples was 0.010 (Comparative example 1), 0.195 (Comparative example 2), 0.983 (Comparative example 3), 0.985 (Comparative example 4), 0.197 (Comparative example 6), 0.012 (Comparative example 7), 0.011 (Comparative example 8), 0.010 (Comparative example 9), and 0.011 (Comparative example 10). That is, with regard to the iron nitride compound layer determined by the intensity ratio by the X-ray diffraction in the present invention, the iron nitride compound layer in each of Comparative examples 1 and 2 was determined that the ϵ phase is the main component. Further, the iron nitride compound layer in each of Comparative examples 6 to 10 was also determined that the c phase is the main component. Further, Comparative examples 3 and 4 were each determined that the γ' phase is the main component.

Incidentally, an area ratio of the γ' phase in the iron nitride compound layer on the cross section of the test piece was examined by using the EBSP (Electron BackScatter Diffraction Pattern) analysis, and then it was possible to confirm that it is 63% (Example 1), 85% (Example 2), 59% (Example 3), and 78% (Example 4) and the γ' phase is rich. Further, in Comparative example 1, it was confirmed that the area ratio of the γ' phase is 0% and the iron nitride compound layer has a single phase of the ϵ phase substantially. Further, according to the EBSP analysis, the area ratio of the γ' phase in Comparative example 3 was 10%, and it was 28% in Comparative example 4. Thus, Comparative example 3 and Comparative example 4 are estimated that the ϵ phase is the main component (the ϵ phase is rich). However, in the determination by the above-described X-ray diffraction intensity ratio, Comparative examples are determined that the γ' phase is the main component (the γ' phase is rich). The difference in the determination results caused by the difference in these two analytical methods is considered as follows. For example, when a photograph of the cross-section analysis by the EBSP in Comparative example 4 was observed, it was confirmed that of the iron nitride compound layer, on the surface side, the γ' phase is rich, and in the inside, the ϵ phase is rich. However, with regard to the X-ray diffraction, only the information of the surface side can be obtained as a characteristic of its analysis, resulting in that Comparative example 4 is determined that the γ' phase is rich. Actually, in the inside of the iron nitride compound layer, the ϵ phase being brittle is rich, and thus it is conceivable that the result of the later-described roller pitting test is inferior to that of Examples.

4. Roller Pitting Test

As a result of the roller pitting test, in Example 1 to Example 8, at a contact pressure of 1300 MPa, no peeling of the iron nitride compound layer on the surface of the test piece was confirmed even after a $1.0\times10^7$ cycle test, resulting in that a fatigue strength condition being the target in the present invention was cleared. Further, in Example 1, even at a contact pressure of 1500 MPa, no peeling of the nitride layer on the surface of the test piece was confirmed after the $1.0\times10^7$ cycle test.

In contract to this, with respect to the test piece in Comparative example 1, at a contact pressure of 1300 MPa, occurrence of a peeling defect was confirmed in many portions of the iron nitride compound layer formed on the surface after a $1.0\times10^4$ cycle test, and at a contact pressure of 1500 MPa, occurrence of a peeling defect was confirmed in many portions of the iron nitride compound layer formed on the surface after a $1.0\times10^3$ cycle test, resulting in that the fatigue strength condition being the target in the present invention was not satisfied. Further, with respect to the test piece in Comparative example 2, at a contact pressure of 1300 MPa, a pitting defect occurred after a $4.2\times10^6$ cycle test, and with respect to the test piece in Comparative example 3, at a contact pressure of 1300 MPa, a pitting defect occurred after a $5.5\times10^6$ cycle test, and in Comparative example 4, at a contact pressure of 1300 MPa, a peeling defect of the iron nitride compound layer occurred after a $1.0\times10^4$ cycle test, resulting in that in each of Comparative examples, the fatigue strength condition being the target in the present invention was not satisfied. Further, with respect to the test piece in Comparative example 7, at a contact pressure of 1300 MPa, a peeling defect of the iron nitride compound layer occurred after a $1.0\times10^3$ cycle test, and with respect to the test piece in Comparative example 8, at a contact pressure of 1300 MPa, a peeling defect of the iron nitride compound layer occurred after a $1.0\times10^3$ cycle test, and in Comparative example 9, at a contact pressure of 1300 MPa, a peeling defect of the iron nitride compound layer occurred after a $5.0\times10^4$ cycle test, and in Comparative example 10, at a contact pressure of 1300 MPa, a peeling defect of the iron nitride compound layer occurred after a $5.0\times10^4$ cycle test, resulting in that in each of Comparative examples, the fatigue strength condition being the target in the present invention was not satisfied.

From the above, it was found that when the thickness of the iron nitride compound layer is about 0 to 0.5 μm (Comparative example 2) and 1 μm (Comparative example 3), a pitting defect occurs at $4.2\times10^6$ cycles and $5.5\times10^6$ cycles, and thus the improvement of the fatigue strength cannot be greatly desired, and further when the thickness of the iron nitride compound layer is 18 μm (Comparative example 4), a peeling defect occurs at $1.0\times10^4$ cycles, and thus the improvement of the fatigue strength cannot be greatly desired. Further, even when the iron nitride compound layer was 15 to 18 μm, in Comparative example 1 and Comparative examples 7 to 10 each having the ϵ phase as the main component, the fatigue strength was small as described above. Further, with respect to Comparative example 6, the roller pitting test was not performed, but similarly to Comparative example 2 and Comparative example 3, the result of which the improvement of the fatigue strength cannot be greatly desired is expected because the iron nitride compound layer in Comparative example 6 is an iron nitride compound layer rich in the ϵ phase that is thinner than that of the invention of the present application.

5. Ono-Type Rotating Bending Test

As a result of the rotating bending fatigue test, in Example 1, the strength at $1.0\times10^5$ cycles is 500 MPa. On the other hand, in Comparative example 1, it is 440 MPa, and it is obvious that the nitriding treatment in Example 1 by the present invention provides the high bending fatigue strength.

6. Strain Amount

A tooth trace correction amount, of the gear test piece for strain amount evaluation, was 5 μm (Example 1), 7 μm (Example 2), 4 μm (Example 3), 8 μm (Example 4), 6 μm (Comparative example 1), 8 μm (Comparative example 2), 6 μm (Comparative example 3), 7 μm (Comparative example 4), and 38 μm (Comparative example 5). Further, the circularity, of the test piece for circularity evaluation, was 15 μm (Example 1), 17 μm (Example 2), 12 μm (Example 3), 18 μm (Example 4), 15 μm (Comparative example 1), 17 μm (Comparative example 2), 15 μm (Comparative example 3), 16 μm (Comparative example 4), and 47 μm (Comparative example 5).

As compared to Comparative example 5 in which the carburizing treatment was performed, the strain amount in Examples 1 to 4 of the invention of the present application was equal to that of Comparative example 1 in which the conventional soft nitriding treatment was performed, and it was confirmed that the high fatigue strength and bending strength can be achieved in a state of the strain amount being small.

Of Examples 1 to 8 and Comparative examples 1 to 10, the steel product type and the nitriding treatment condition (the temperature, the treatment time, the $N_2$ gas partial pressure, the $NH_3$ gas partial pressure, and the $H_2$ partial pressure) are shown collectively in Table 1. The chemical composition of the steel product type of Examples 1 to 8 and Comparative examples 1 to 10 is shown in Tables 2 to 6. As the property (roller pitting test) of Examples 1 to 8 and Comparative examples 1 to 10, the result shown in Table 7 was obtained.

Example 9

It was examined whether the nitrided steel member of the present invention can be manufactured even when the nitriding treatment temperature is changed. First, as a sample product, a steel member made of alloy steel for machine structural use SCM420 was prepared. The shape of the steel member was set to a disk-shaped test piece for nitride quality confirmation. Next, as a treatment prior to the nitriding, on the test piece, vacuum cleaning and degreasing and drying were performed. Next, the nitriding treatment was performed on the steel member.

First, in the temperature increasing process, the flow amount of the $NH_3$ gas to be supplied into the furnace (heating chamber) was set to 10 L/min, and the flow amount of the $N_2$ gas to be supplied into the furnace (heating chamber) was set to 40 L/min, and the temperature was increased up to the nitriding treatment temperature. As the condition of the nitriding treatment performed subsequently, the temperature was set to 570° C., the nitriding time was set to 3 hours (time), the gas flow amounts of the $NH_3$ gas, the $H_2$ gas, and the $N_2$ gas supplied into the furnace were each adjusted, and when the total pressure in the furnace was set to 1, the partial pressure ratio of the $NH_3$ gas was set to 0.17 (the $NH_3$ gas partial pressure was 17.2 kPa), the partial pressure ratio of the $H_2$ gas was set to 0.73 (the $H_2$ gas partial pressure was 74.0 kPa), and the partial pressure ratio of the $N_2$ gas was set to 0.10 (the $N_2$ gas partial pressure was 10.1 kPa). Incidentally, the total pressure in the furnace at the time of the nitriding treatment was an atmospheric pressure, and the nitriding gas was strongly stirred by increasing the number of rotations of the fan, to thereby set the gas flow speed (wind speed) of the in-furnace gas coming into contact with the test piece to 2 to 2.6 m/s. Thereafter, the test piece was immersed in the oil at 130° C. to be subjected to oil cooling, and the evaluation was performed. Incidentally, the $NH_3$ partial pressure, the $H_2$ partial pressure, and the $N_2$ partial pressure in the nitriding treatment gas, and the gas flow speeds were measured in the manner similar to that of Example 1 described above.

Example 10

A test piece was manufactured by the manufacturing method similar to that of Example 9 except that as a sample product, a disk-shaped steel member made of SCr420 was prepared.

Example 11

A test piece was manufactured by the manufacturing method similar to that of Example 9 except that as a sample product, a disk-shaped steel member made of SACM645 was prepared.

(Evaluation Result)

By the above-described methods, of the test pieces in Examples 9 to 11, the measurement of the thickness of the iron nitride compound layer, the measurement of the depth (thickness) of the nitrogen diffusion layer, and the analysis of the compound layer by the X-ray diffraction were performed. The thickness of the iron nitride compound layer in each of Examples 9 to 11 was 7 μm (Example 9), 5 μm (Example 10), and 2 μm (Example 11). The thickness of the nitrogen diffusion layer in each of Examples 9 to 11 was 0.142 mm (Example 9), 0.131 mm (Example 10), and 0.121 mm (Example 11). The intensity ratio by the X-ray diffraction in each of Examples 9 to 11 was 0.981 (Example 9), 0.981 (Example 10), and 0.984 (Example 11), and in each of Examples, the intensity ratio was 0.5 or more and the iron nitride compound layer was determined that the γ' phase is the main component. From the above, it was confirmed that even by the nitriding treatment in a relatively low temperature range, the nitrided steel member of the present invention can be manufactured.

TABLE 1

| | | NITRIDING TREATMENT CONDITION (EACH PARTIAL PRESSURE INDICATES RATIO WHEN TOTAL PRESSURE IS SET TO 1) | | | | | |
|---|---|---|---|---|---|---|---|
| | STEEL PRODUCT TYPE | TEMPERATURE | TREATMENT TIME | $N_2$ GAS PARTIAL PRESSURE RATIO | $NH_3$ GAS PARTIAL PRESSURE RATIO | $H_2$ GAS PARTIAL PRESSURE RATIO | NOTE |
| EXAMPLE 1 | SCM420 | 600° C. | 1.5 h | 0.13 | 0.15 | 0.72 | |
| EXAMPLE 2 | SCM420 | 600° C. | 2 h | 0.09 | 0.14 | 0.77 | |
| EXAMPLE 3 | SCM420 | 600° C. | 2 h | 0.16 | 0.12 | 0.72 | |
| EXAMPLE 4 | SCM420 | 610° C. | 8 h | 0.14 | 0.1 | 0.76 | |
| EXAMPLE 5 | SCr420 | 600° C. | 2 h | 0.10 | 0.16 | 0.74 | |
| EXAMPLE 6 | SACM645 | 600° C. | 2 h | 0.10 | 0.16 | 0.74 | |
| EXAMPLE 7 | SNCM220 | 600° C. | 2 h | 0.10 | 0.16 | 0.74 | |
| EXAMPLE 8 | S35C | 600° C. | 2 h | 0.10 | 0.16 | 0.74 | |
| EXAMPLE 9 | SCM420 | 570° C. | 3 h | 0.10 | 0.17 | 0.73 | |
| EXAMPLE 10 | SCr420 | 570° C. | 3 h | 0.10 | 0.17 | 0.73 | |
| EXAMPLE 11 | SACM645 | 570° C. | 3 h | 0.10 | 0.17 | 0.73 | |
| COMPARATIVE EXAMPLE 1 | SCM420 | 570° C. | 2 h | 0.32 | 0.4 | 0.28 | |
| COMPARATIVE EXAMPLE 2 | SCM420 | 610° C. | 2 h | 0.05 | 0.1 | 0.85 | |
| COMPARATIVE EXAMPLE 3 | SCM420 | 610° C. | 2 h | 0.08 | 0.1 | 0.82 | |
| COMPARATIVE EXAMPLE 4 | SCM420 | 610° C. | 7 h | 0.13 | 0.14 | 0.73 | |
| COMPARATIVE EXAMPLE 5 | SCM420 | — | — | — | — | — | GAS CARBURIZING |
| COMPARATIVE EXAMPLE 6 | SCM420 | 600° C. | 1.5 h | 0.13 | 0.15 | 0.72 | |
| COMPARATIVE EXAMPLE 7 | SCr420 | 600° C. | 2 h | 0.32 | 0.4 | 0.28 | |
| COMPARATIVE EXAMPLE 8 | SACM645 | 600° C. | 2 h | 0.32 | 0.4 | 0.28 | |
| COMPARATIVE EXAMPLE 9 | SNCM220 | 600° C. | 2 h | 0.32 | 0.4 | 0.28 | |
| COMPARATIVE EXAMPLE 10 | S35C | 580° C. | 1.5 h | 0.32 | 0.4 | 0.28 | |

TABLE 2

| | C | Si | Mn | P | S | Cr | Mo | O | STEEL TYPE NAME |
|---|---|---|---|---|---|---|---|---|---|
| STEEL TYPE 1 | 0.21 | 0.25 | 0.81 | 0.008 | 0.016 | 1.12 | 0.17 | 0.008 | SCM420 |
| | | | | | | | | (mass %) | |

TABLE 3

| | C | Si | Mn | P | S | Cr | Mo | O | STEEL TYPE NAME |
|---|---|---|---|---|---|---|---|---|---|
| STEEL TYPE 2 | 0.205 | 0.25 | 0.725 | 0.03 OR LESS | 0.03 OR LESS | 1.05 | — | | SCr420 |
| | | | | | | | | (mass %) | |

TABLE 4

| | C | Si | Mn | P | S | Cr | Mo | Al | STEEL TYPE NAME |
|---|---|---|---|---|---|---|---|---|---|
| STEEL TYPE 3 | 0.45 | 0.325 | 0.06 OR LESS | 0.03 OR LESS | 0.03 OR LESS | 1.5 | 0.225 | 0.95 | SACM645 |
| | | | | | | | | (mass %) | |

TABLE 5

| | C | Si | Mn | P | S | Cr | Mo | Ni | STEEL TYPE NAME |
|---|---|---|---|---|---|---|---|---|---|
| STEEL TYPE 4 | 0.2 | 0.25 | 0.55 | 0.03 OR LESS | 0.03 OR LESS | 0.525 | 0.225 | 1.8 | SNCM420 |
| | | | | | | | | (mass %) | |

TABLE 6

| | C | Si | Mn | P | S | Cr | Mo | O | STEEL TYPE NAME |
|---|---|---|---|---|---|---|---|---|---|
| STEEL TYPES | 0.35 | 0.25 | 0.75 | 0.03 OR LESS | 0.035 OR LESS | — | — | | S35C |
| | | | | | | | | (mass %) | |

TABLE 7

| | IRON NITRIDE COMPOUND LAYER | | | | DEPTH OF NITROGEN DIFFUSION LAYER | ROLLER PITTING TEST RESULT | | ONO-TYPE ROTATING BENDING FATIGUE TEST | | GEAR STRAIN AMOUNT TOOH TRACE | |
|---|---|---|---|---|---|---|---|---|---|---|---|
| | THICKNESS | XRD DIFFRACTION INTENSITY RATIO | EBSP ANALYSIS AREA RATIO OF γ' PHASE | FORM | | CONDITION (CONTACT PRESSURE) | RESULT | CONDITION (CYCLE) | RESULT | INCLINATION VARIATION | CIRCURLARITY VARIATION |
| EXAMPLE 1 | 6 μm | 0.978 | 63% | γ' PHASE RICH | 0.22 mm | 1500 MPa | $1.0 \times 10^7$ CYCLES NO PEELING | $1.0 \times 10^5$ CYCLES | 500 MPa | 5 μm | 15 μm |
| | | | | | | 1300 MPa | $1.0 \times 10^7$ CYCLES NO PEELING | | | | |
| EXAMPLE 2 | 2 μm | 0.986 | 85% | γ' PHASE RICH | 0.28 mm | 1300 MPa | $1.0 \times 10^7$ CYCLES NO PEELING | — | — | 7 μm | 17 μm |
| EXAMPLE 3 | 9 μm | 0.981 | 59% | γ' PHASE RICH | 0.20 mm | 1300 MPa | $1.0 \times 10^7$ CYCLES NO PEELING | — | — | 4 μm | 12 μm |
| EXAMPLE 4 | 13 μm | 0.982 | 78% | γ' PHASE RICH | 0.52 mm | 1300 MPa | $1.0 \times 10^7$ CYCLES NO PEELING | — | — | 8 μm | 18 μm |
| EXAMPLE 5 | 10 μm | 0.981 | — | γ' PHASE RICH | 0.23 mm | 1300 MPa | $1.0 \times 10^7$ CYCLES NO PEELING | — | — | — | — |
| EXAMPLE 6 | 3 μm | 0.979 | — | γ' PHASE RICH | 0.18 mm | 1300 MPa | $1.0 \times 10^7$ CYCLES NO PEELING | — | — | — | — |
| EXAMPLE 7 | 7 μm | 0.980 | — | γ' PHASE RICH | 0.20 mm | 1300 MPa | $1.0 \times 10^7$ CYCLES NO PEELING | — | — | — | — |
| EXAMPLE 8 | 11 μm | 0.980 | — | γ' PHASE RICH | 0.11 mm | 1300 MPa | $1.0 \times 10^7$ CYCLES NO PEELING | — | — | — | — |
| EXAMPLE 9 | 7 μm | 0.981 | — | γ' PHASE RICH | 0.142 mm | — | — | — | — | — | — |
| EXAMPLE 10 | 5 μm | 0.981 | — | γ' PHASE RICH | 0.131 mm | — | — | — | — | — | — |
| EXAMPLE 11 | 2 μm | 0.984 | — | γ' PHASE RICH | 0.121 mm | — | — | — | — | — | — |
| COMPARATIVE EXAMPLE 1 | 15 μm | 0.010 | 0% | ε PHASE RICH | 0.22 mm | 1500 MPa | $1.0 \times 10^3$ CYCLES PEELING OCCURED | $1.0 \times 10^5$ CYCLES | 440 MPa | 6 μm | 15 μm |
| | | | | | | 1300 MPa | $1.0 \times 10^4$ CYCLES PEELING OCCURED | | | | |
| COMPARATIVE EXAMPLE 2 | 0~0.5 μm | 0.195 | — | ε PHASE RICH | 0.21 mm | 1300 MPa | $4.2 \times 10^6$ CYCLES PITTING OCCURED | — | — | 8 μm | 17 μm |
| COMPARATIVE EXAMPLE 3 | 1 μm | 0.983 | 10% | ε PHASE RICH | 0.21 mm | 1300 MPa | $5.5 \times 10^6$ CYCLES PITTING OCCURED | — | — | 6 μm | 15 μm |
| COMPARTIVE EXAMPLE 4 | 18 μm | 0.985 | 28% | ε PHASE RICH | 0.47 mm | 1300 MPa | $1.0 \times 10^4$ CYCLES PEELING OCCURED | — | — | 7 μm | 16 μm |
| COMPARATIVE EXAMPLE 5 | CARBURIZING TREATMENT | | | | | — | — | — | — | 38 μm | 47 μm |
| COMPARATIVE EXAMPLE 6 | 0~0.5 μm | 0.197 | — | ε PHASE RICH | 0.20 mm | — | — | — | — | — | — |
| COMPARATIVE EXAMPLE 7 | 18 μm | 0.012 | — | ε PHASE RICH | 0.24 mm | 1300 MPa | $1.0 \times 10^3$ CYCLES PEELING OCCURED | — | — | — | — |
| COMPARATIVE EXAMPLE 8 | 15 μm | 0.011 | — | ε PHASE RICH | 0.19 mm | 1300 MPa | $1.0 \times 10^3$ CYCLES PEELING OCCURED | — | — | — | — |
| COMPARATIVE EXAMPLE 9 | 17 μm | 0.010 | — | ε PHASE RICH | 0.21 mm | 1300 MPa | $5.0 \times 10^4$ CYCLES PEELING OCCURED | — | — | — | — |

TABLE 7-continued

| | IRON NITRIDE COMPOUND LAYER | | | | | ONO-TYPE | | | | | |
|---|---|---|---|---|---|---|---|---|---|---|---|
| | | XRD DIFFRACTION | EBSP ANALYSIS | | DEPTH OF NITROGEN | ROLLER PITTING TEST RESULT CONDITION | | ROTATING BENDING FATIGUE TEST | | GEAR STRAIN AMOUNT TOOH TRACE | |
| | THICKNESS | INTENSITY RATIO | AREA RATIO OF γ' PHASE | FORM | DIFFUSION LAYER | (CONTACT PRESSURE) | RESULT | CONDITION (CYCLE) | RESULT | INCLINATION VARIATION | CIRCURLARITY VARIATION |
| COMPARATIVE EXAMPLE 10 | 16 μm | 0.011 | — | ε PHASE RICH | 0.10 mm | 1300 MPa | $5.0 \times 10^4$ CYCLES PEELING OCCURED | — | — | — | — |

INDUSTRIAL APPLICABILITY

The present invention is effective for a nitriding technique of steel.

EXPLANATION OF CODES

1 heat treatment apparatus
10 carry-in part
11 heating chamber
12 cooling chamber
13 carry-out conveyer
20 case
21 door
22 entrance hood
26 fan
30 elevator
31 oil
32 oil tank
35 door
36 exit hood
100 small roller
101 large roller
102 test piece

The invention claimed is:

1. A nitrided steel member comprising:

an iron nitride compound layer including a γ' phase as a main component and an ϵ phase and formed on a surface of a steel member made of carbon steel for machine structural use or alloy steel for machine structural use, wherein with regard to X-ray diffraction peak intensity $IFe_4N$ (111) of the (111) crystal plane of $Fe_4N$ and X-ray diffraction peak intensity $IFe_3N$ (111) of the (111) crystal plane of $Fe_3N$ obtained by measuring a surface of the nitrided steel member by X-ray diffraction, an intensity ratio represented by $IFe_4N$ (111)/{$IFe_4N$ (111)+$IFe_3N$ (111)} is 0.5 or more, and a thickness of the iron nitride compound layer is 2 to 17 μm.

2. The nitrided steel member according to claim 1, further comprising:

a nitrogen diffusion layer.

3. The nitrided steel member according to claim 1 being a gear to be used for a transmission.

4. A manufacturing method of the nitrided steel member according to claim 1, comprising:

performing a nitriding treatment on a steel member made of carbon steel for machine structural use or alloy steel for machine structural use in an atmosphere of a nitriding treatment gas in which when the total pressure is set to 1, a partial pressure ratio of $NH_3$ gas is set to 0.08 to 0.34, a partial pressure ratio of $H_2$ gas is set to 0.54 and 0.82, and a partial pressure ratio of $N_2$ gas is set to 0.09 to 0.18, at a flow speed of the nitriding treatment gas set to 1 m/s or more, at 500 to 620° C.; and thereby, forming an iron nitride compound layer including a γ' phase as a main component and an ϵ phase and having a thickness of 2 to 17 μm on a surface of the steel member.

* * * * *